United States Patent [19]

Sauthier

[11] 3,958,182

[45] May 18, 1976

[54] ELECTRONIC CIRCUIT FOR SUPPLYING ENERGIZING PULSES OF PREDETERMINED DURATION TO AN ELECTRIC MOTOR

[75] Inventor: Pierre Sauthier, Brugg, Switzerland

[73] Assignee: Societe Suisse pour l'Industrie Horlogere Management Servies S.A., Switzerland

[22] Filed: Sept. 11, 1974

[21] Appl. No.: 504,890

[30] Foreign Application Priority Data

Oct. 4, 1973 Switzerland ..... 14192/73

[52] U.S. Cl. ..... 328/58; 307/225 R; 307/265; 328/48; 318/341; 318/696

[51] Int. Cl.[2] ..... H03K 5/04; H03K 21/32; G05B 19/40

[58] Field of Search ..... 328/48, 58; 307/265, 307/225 R; 318/341, 696

[56] References Cited

UNITED STATES PATENTS

| | | | |
|---|---|---|---|
| 3,379,897 | 4/1968 | Kaminski | 307/225 |
| 3,629,710 | 12/1971 | Durland | 307/265 |
| 3,697,879 | 10/1972 | Holliday | 307/265 |
| 3,870,962 | 3/1975 | D'Errico | 307/265 |

*Primary Examiner*—Stanley D. Miller, Jr.
*Attorney, Agent, or Firm*—Griffin, Branigan and Butler

[57] ABSTRACT

An electronic circuit for supplying energizing pulses of predetermined duration to an electric motor comprises a principal chain of frequency dividing elements, a bistable multivibrator, and an auxiliary divider circuit comprising a secondary chain of series connected binary elements arranged to shunt at least some of the elements in the principal chain.

8 Claims, 5 Drawing Figures

ELECTRONIC CIRCUIT FOR SUPPLYING ENERGIZING PULSES OF PREDETERMINED DURATION TO AN ELECTRIC MOTOR

In electronic time keeping or time measuring instruments employing a frequency standard there will frequently be utilized a transducer for converting information available in the form of electric pulses into a mechanical movement. Stepping motors are particularly well adapted for this function. Such motors in general comprise among other things an induction winding the terminals of which are coupled to an electronic control circuit. Such circuit supplies electronic driving pulses to the winding having a certain duration ( $\tau i$) at a repetition frequency ($fr$) or a period ($\tau r$), the number of which characterizes the information to be converted, that is to say the time or period of time measured. The frequency (fr) or the period ($\tau r$) are generally determined by the last stage of a frequency divider and in most cases will be respectively 1 Hz or 1 s. The pulse length ($\tau i$) in order to guarantee satisfactory operation must be compatible with the motor characteristics. Generally, such conditions are satisfied through the choice of motors capable of being energized by pulses the duration of which in ms closely approximates an integral power of 2, for example 4 ms, 8 ms, 16 ms or 32 ms. Such pulse durations correspond almost exactly to the pulse periods which may be obtained at the output of each frequency divider stage, the stages in the above examples providing respectively outputs at 256 Hz, 128 Hz, 164 Hz and 32 Hz. Thus it is sufficient to take a signal on the output of a suitable frequency divider stage in order to obtain pulses of the desired duration for energizing the motor.

In certain instances, however, it will be desirable to use motors for which the energizing pulse duration will be different from one of those precedingly mentioned. The present invention is concerned with a circuit adapted to the generation of this latter type of pulse.

Up to the present two varieties of circuit have been suggested to attain this end. Thus one might employ a monostable circuit including an RC time constant or alternately one might employ a bistable multivibrator (flip-flop) for which the reset input receives pulses obtained from a decoding circuit, the latter including a combination of NOR- and NAND-gates. Each of these two types of circuit has certain disadvantages owing to its nature and to which reference will subsequently be made in order to demonstrate the advantages of the present invention.

The invention thus comprises an electronic circuit for supplying energizing pulses of predetermined duration to an electric motor used to drive information displays in time measuring or timekeeping devices, such duration being required by the motor characteristics, the circuit comprising a principal chain of frequency dividing elements and a bistable multivibrator and wherein the pulse duration is determined exclusively by a auxiliary divider circuit comprising a secondary chain of series connected binary elements arranged to shunt at least certain elements in the principal chain.

For a better understanding of the invention the following description should be referred to in conjunction with the attached drawings in which the same elements are referred to by the same reference number and in which FIG. 1 shows the state of the art in respect of motors requiring a plus duration of $2^n$ ms.

Figure 1:
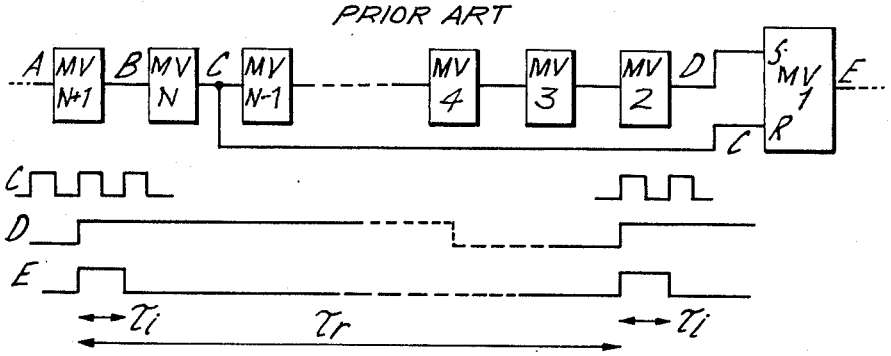
FIG. 1. PRIOR ART

In the prior art circuit of FIG. 1, the pulse frequency as generated by the time standard (not shown) is halved a predetermined number of times by binary divider stages (2, 3, 4, ..... N-1, N, N+1.....) connected to one another in a manner so as to provide pulses (D) having a frequency (fr) of for example 1 Hz at the set input (S) of a bistable multivibrator or flip-flop (1). The bistable multivibrator 1 in turn provides pulses (E) at a frequency of 1 Hz to energize the motor (not shown) and the duration of such pulses is controlled by the reset input (R) of multivibrator 1.

When pulses having a duration of $2^n$ ms (or having the form ½k s) are compatible with the motor requirements and as shown in FIG. 1, pulses (C) obtained directly from the output of one of the intermediate divider stages (N on the drawing) are fed to the reset input (R) of multivibrator 1. The period of these pulses (C) is then equal to the duration ($\tau i$) of pulses (E) at the output of multivibrator 1 which will energize the motor.

If the motor is to be energized by pulses having an intermediate duration one might use an auxiliary monostable circuit (not shown). The latter would have a stable reset state and could assume during a certain time an inverted state of which the beginning could be determined by a frequency divider stage for example the last stage 2 having a frequency of 1 Hz. The duration of this unstable state and thus that ($\tau i$) of the pulse going to the motor would then depend on the time constant (RC). This leads to certain difficulties inasmuch as the capacitor required is much too large to be incorporated into an integrated circuit. In addition to occupying a considerable volume such capacitor would require at least two additional connections on an integrated circuit. Furthermore, the precision of the pulse duration ($\tau i$) would depend from the resistance (R) (replaced by a current source) and from the external capacitor. Such precision is poor and would have to be adjusted in every case during manufacture. Finally, the resistance and capacitor components are subject to ageing and their temperature coefficient has a direct and bad influence on the duration ($\tau i$) of the pulse.

Figure 2:
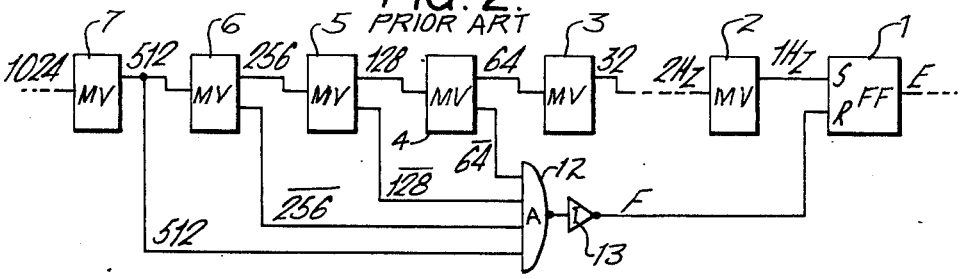
FIG. 2. PRIOR ART
FIGS. 2 and 3 show the state of the art relative to generation of pulses of intermediate length through use of a decoder circuit. A detail of the timing diagram of FIG. 3 has been enlarged for greater clarity.

Such difficulties have been avoided in the prior art through the use of a decoder circuit which may be completely integrated. In such an arrangement, as illustrated in FIG. 2, the outputs of several consecutive stages of the frequency divider are combined so as to provide the bistable multivibrator with pulses of which the first leading edge will arrive n ms after the low frequency pulse at 1 Hz. An example for $n = 14$ i.e. $\tau i =$ 14 ms is shown in FIG. 2.

Figure 3:
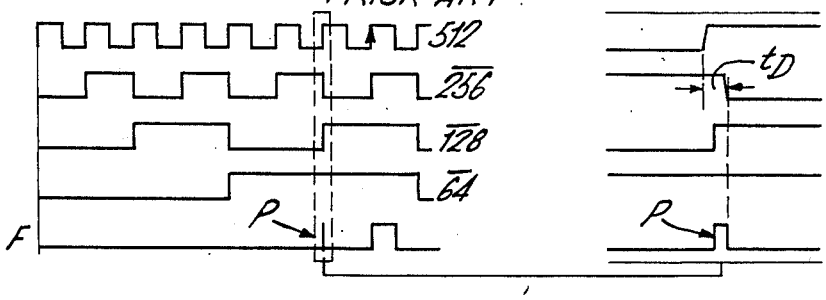
FIG. 3. PRIOR ART

This type of circuit also presents certain difficulties in principle as shown in FIG. 3 owing to the fact that the switches exhibit a response time (tD) between the moment of reception of an input signal and the moment of effective change-over. Thus may arrive voltage peaks (spikes) at undesired moments, the result of which may shorten the duration ($\tau i$) of the pulse. The presence and duration of these voltage peaks depend in large measure on the supply voltage, the temperature and the nature of the decoding circuit.

A further problem resides in the difficulty of implantation of such decoder circuit in bipolar technology. Relative to the usual elements found in an integrated bipolar circuit as used in electronic timekeeping which is to say binary switches and bistable multivibrators, a decoder circuit formed of NAND- or NOR-gates constitutes a supplementary element which may be critical in view of the low voltage at which the circuit must continue to function. This difficulty prevents use of logic circuits of the TTL type (transistor transistor logic) and requires DCTL (direct coupling transistor logic) circuits which likewise may cause difficulties as for example the phenomenon known as current hogging.

The circuit of the invention, which may be realized either through bipolar or CMOS technology and may be formed in its entirety as a monolithic integrated circuit, avoids the hereinbefore mentioned difficulties while fulfilling the same functions. Furthermore it provides the following advantages:

The only components required are those which are conventional for this type of circuit, which is to say bistable switches or flipflops having a reset to zero, in addition to the preexisting divider elements.

Only one intermediate frequency signal is required between the high frequency of the standard and the low frequency of the motor, for example respectively 32 768 Hz and 1 Hz. This reduces the problem of connections.

The circuit is very flexible in respect of the desired duration of the pulse ($\tau i$) which depends only on the number of supplementary switches and their residual condition following reset.

The duration ($\tau i$) has the same precision as the frequency standard since it depends only on logic signals.

Figure 4:
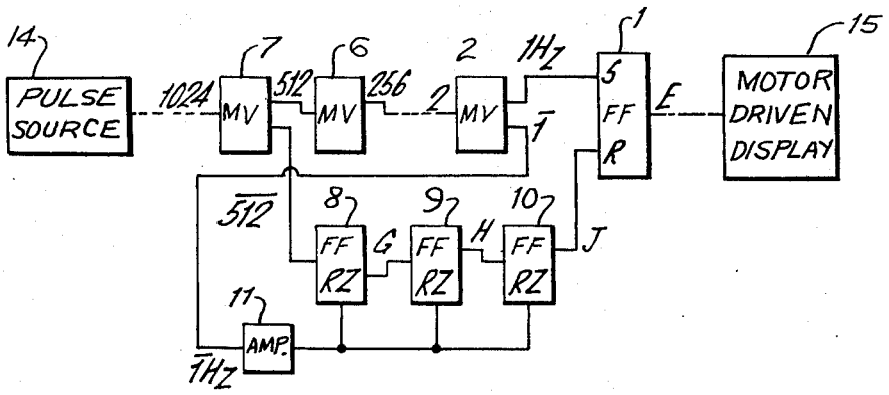
FIG. 4 is a schematic drawing of a circuit in accordance with the invention.
Figure 5:
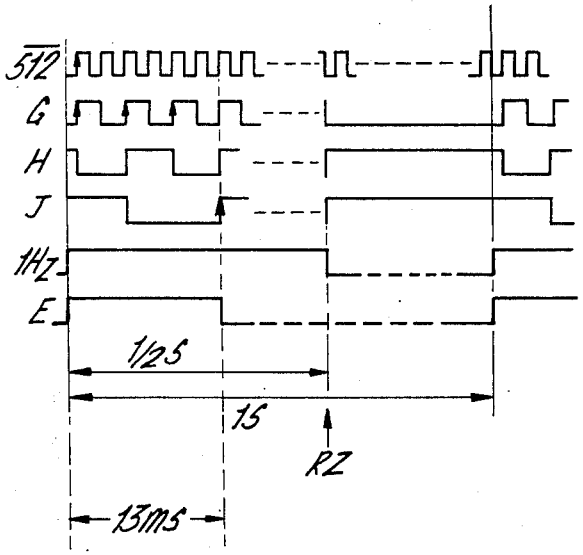
FIG. 5 is a timing diagram showing the pulse forms present at various stages of the circuit of FIG. 4.

Such circuit may be as illustrated, for example, in FIG. 4 with signals as shown in FIG. 5. It will be assumed that the motor requires a pulse duration ($\tau i$) = 13 ms. Thus between two basic durations, namely 8 ms and 16 ms, the intermediate frequency utilized as derived from the chain of divider stages 2 to 7 may be 1024 Hz at the input stage 7 or a complement of 512 Hz, i.e. 512 Hz at the output of stage 7. This latter frequency may be chosen to avoid useless stages. The signal thus obtained is shunted by three binary switches or flipflops 8, 9, 10 having reset inputs (RZ) before arriving at the reset input (R) of the bistable multivibrator 1. As may be seen from FIG. 5 the signal thus obtained (J) exhibits a leading positive edge 13 ms after the beginning of the pulse which is given by the signal 1 Hz (or 0.5 Hz and 0.5 Hz in the case of energizing pulses for bipolar motors). The additional switches 8, 9, 10 must be reset to zero, at the latest, just before the beginning of a motor pulse. One may consider for example the signal 1 Hz (complement of 1 Hz) amplified 11 to assume this function in considering that state 1 causes blocking of switches 8, 9, 10 while state 0 enables their normal counting activity. Thus during the first ½ second following the beginning of a pulse the supplementary circuit 8 to 11 will provide at the input (R) of multivibrator 1 a series of pulses for which only the first has an effect. During the next ½ second the additional circuit will be blocked.

I claim:

1. An electronic circuit for generating pulses of predetermined duration, said circuit comprising:

a principal chain of frequency dividing elements;

an auxiliary chain of frequency dividing elements;

means for driving both said principal chain and said auxiliary chain from a common source of pulses for simultaneous operation of both said principal and auxiliary chains;

a bistable multivibrator responsive to pulses at first and second inputs for assuming first and second stable states to thereby produce said pulses of predetermined duration;

means connecting said principal chain to one input of said bistable multivibrator; and, means connecting said auxiliary chain to the second input of said bistable multivibrator, said means for driving both said principal chain and said auxiliary chain including a pulse source connected to the input of said principal chain of frequency dividing elements, and means connecting an output of an intermediate element of said principal chain of elements to the input of said auxiliary chain of frequency dividing elements.

2. An electronic circuit as claimed in claim 1 wherein said predetermined duration of the pulses generated by said electronic circuit is determined by the number of frequency dividing elements in said auxiliary chain and the frequency of the input pulses to said auxiliary chain.

3. An electronic circuit as claimed in claim 1 wherein all said frequency dividing elements are bistable multivibrators.

4. An electronic circuit as claimed in claim 1 wherein each frequency dividing element of said auxiliary chain includes means responsive to a reset signal for resetting the element to zero; and means responsive to a single pulse produced by one of the frequency dividing elements of said principal chain for simultaneously applying a reset signal to each frequency dividing element of said auxiliary chain.

5. An electronic circuit as claimed in claim 4 wherein said means responsive to a single pulse comprises means connected to the last frequency dividing element of said principal chain.

6. An electronic circuit as claimed in claim 5 wherein the circuit is formed in its entirety as a monolithic integrated circuit.

7. An electronic circuit as claimed in claim 5 wherein all said frequency dividing elements are bistable multivibrators.

8. An electronic circuit as claimed in claim 5 in combination with an electronic motor driven time display device, and means connecting an output of said bistable multivibrator to said electric motor.

* * * * *

UNITED STATES PATENT AND TRADEMARK OFFICE

CERTIFICATE OF CORRECTION

PATENT NO. : 3,958,182
DATED : May 18, 1976
INVENTOR(S) : Pierre Sauthier

It is certified that error appears in the above-identified patent and that said Letters Patent are hereby corrected as shown below:

In the heading, at [73], change to read:
Assignee: Sociète Suisse pour l'Industrie Horlogere Management Services S.A., Switzerland In the heading, at [75], change "Brugg" to --Bruegg--.

Column 2, line 2, for "plus," read --pulse--.

Column 3, line 46, for "512 Hz" read --512 Hz--.

Column 3, line 54, for "0.5 Hz" (2nd occurrence), read --0.5 Hz--.

Column 3, line 58, for "1 Hz" (1st occurrence) read --1 Hz--.

Signed and Sealed this
Third Day of August 1976

[SEAL]

*Attest:*

RUTH C. MASON
*Attesting Officer*

C. MARSHALL DANN
*Commissioner of Patents and Trademarks*